US007568638B2

(12) United States Patent
Gehrung

(10) Patent No.: US 7,568,638 B2
(45) Date of Patent: Aug. 4, 2009

(54) VENTILATED GRAVITY CUP FOR A PAINT SPRAY GUN

(75) Inventor: Ralf Gehrung, Stuttgart (DE)

(73) Assignee: Sata GmbH & Co. KG, Kornwestheim (DE)

( * ) Notice: Subject to any disclaimer, the term of this patent is extended or adjusted under 35 U.S.C. 154(b) by 34 days.

(21) Appl. No.: 11/568,351

(22) PCT Filed: Oct. 23, 2004

(86) PCT No.: PCT/EP2004/011998

§ 371 (c)(1),
(2), (4) Date: Mar. 27, 2007

(87) PCT Pub. No.: WO2005/115631

PCT Pub. Date: Dec. 8, 2005

(65) Prior Publication Data

US 2007/0221754 A1 Sep. 27, 2007

(30) Foreign Application Priority Data

Apr. 29, 2004 (DE) ..... 10 2004 021 298

(51) Int. Cl.
*B05B 7/30* (2006.01)
*A62C 5/00* (2006.01)

(52) U.S. Cl. ..... 239/345; 239/346; 239/311; 222/105; 222/83.5

(58) Field of Classification Search ..... 239/345, 239/347; 222/481.5, 481; 215/11.5, 902
See application file for complete search history.

(56) References Cited

U.S. PATENT DOCUMENTS 2,609,961 A 9/1952 Sapien
2,844,267 A * 7/1958 Petriccione ..... 215/388

(Continued)

FOREIGN PATENT DOCUMENTS

DE 87 02 559 U 9/1987

(Continued)

OTHER PUBLICATIONS

International Search Report PCT/EP2004/011998.

(Continued)

*Primary Examiner*—Len Tran
*Assistant Examiner*—James S Hogan
(74) *Attorney, Agent, or Firm*—Martin Fleit; Paul D. Bianco; Fleit Gibbons Gutman Bongini & Bianco PL

(57) ABSTRACT

The invention relates to a gravity cup for a paint spray gun. The gravity cup includes a reservoir (1) and a lid (2) that is placed thereon and that has a connecting part (3) so that the gravity cup can be placed on the paint spray gun or an adapter. The reservoir (1) is provided, in a wall (4) thereof, with a ventilation hole (6) that can be obturated by means of a valve (5). The aim of the invention is to provide a gravity cup that comprises a valve that can be easily actuated by hand so as to obturate the ventilation hole. For this purpose, the valve (5) is configured as a sliding valve comprising a valve housing (7) and a slide (8) that can be displaced in relation to the valve housing (7) in a direction of displacement (V) extending parallel to the wall (4).

12 Claims, 4 Drawing Sheets

U.S. PATENT DOCUMENTS

| | | | | |
|---|---|---|---|---|
| 4,411,387 | A * | 10/1983 | Stern et al. | 239/345 |
| 5,020,700 | A | 6/1991 | Krzywdziak et al. | |
| 5,582,350 | A * | 12/1996 | Kosmyna et al. | 239/345 |
| 6,543,632 | B1 * | 4/2003 | McIntyre et al. | 215/11.5 |
| 6,786,345 | B2 * | 9/2004 | Richards | 215/11.5 |
| 6,820,824 | B1 * | 11/2004 | Joseph et al. | 239/346 |
| 7,416,140 | B2 * | 8/2008 | Camilleri et al. | 239/321 |

FOREIGN PATENT DOCUMENTS

| | | |
|---|---|---|
| EP | 1 424 135 | 6/2004 |
| WO | WO 98/32539 A | 7/1998 |
| WO | WO 03/045575 | 6/2003 |

OTHER PUBLICATIONS

International Preliminary Report on Patentability PCT/EP2004/011998.

* cited by examiner

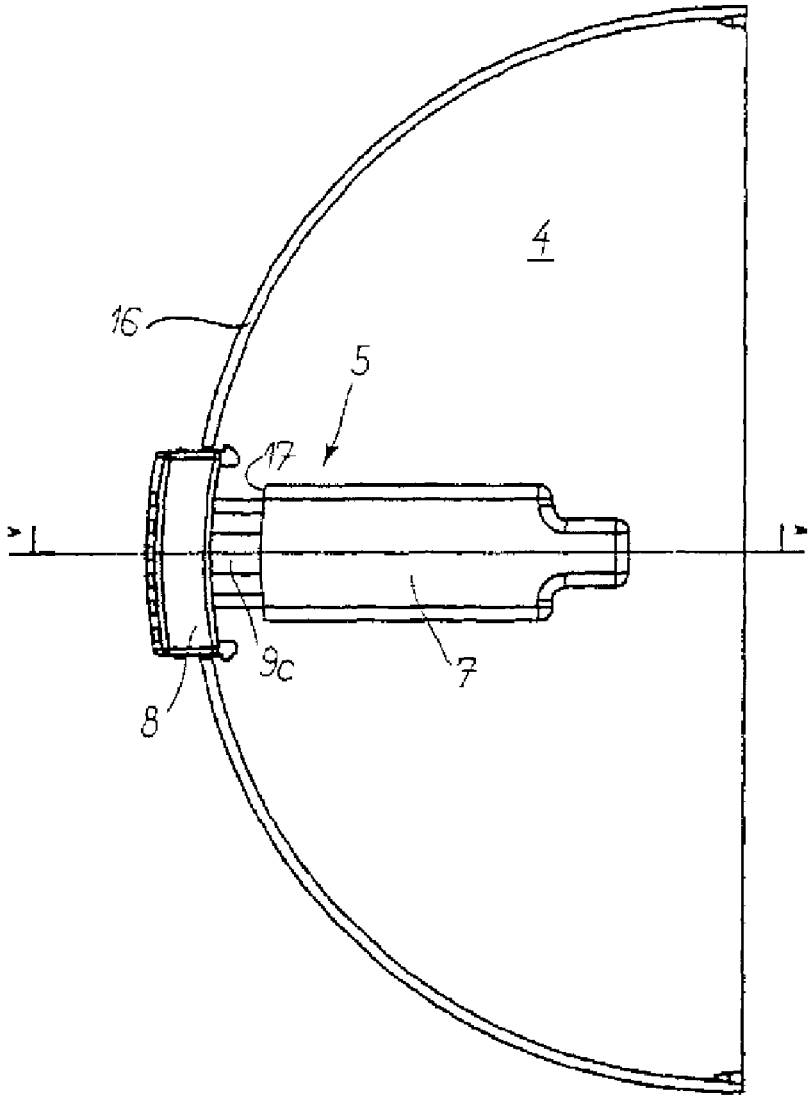
(a)
Fig. 2
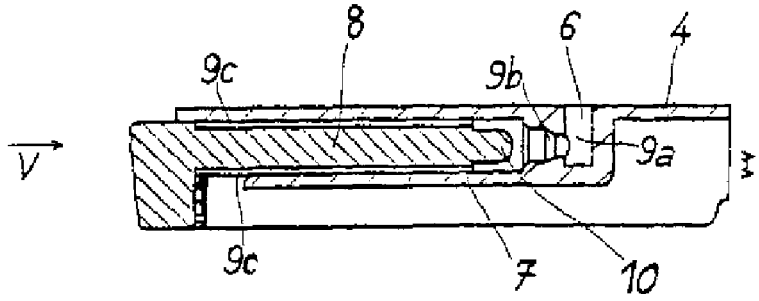
(b)

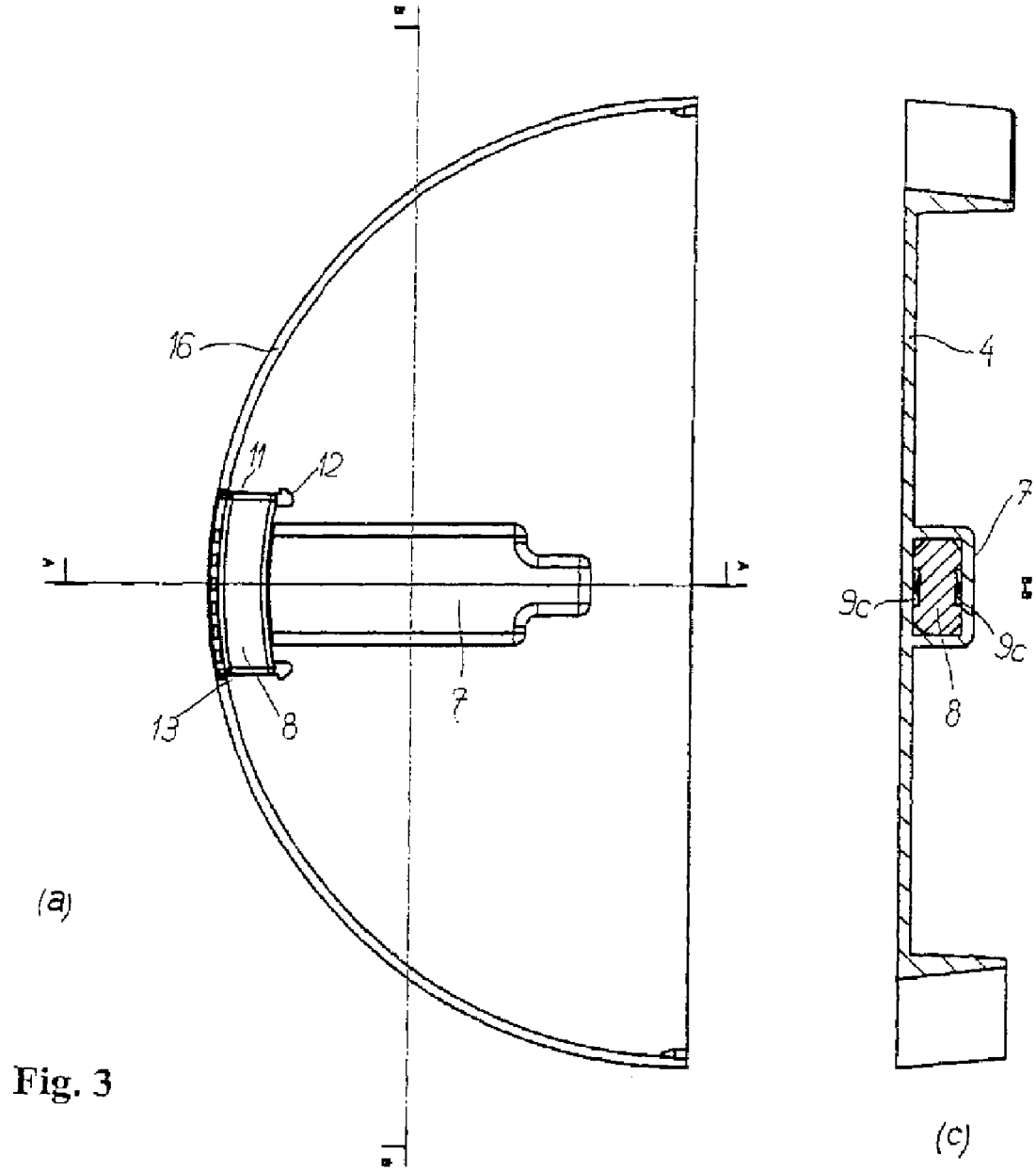
Fig. 3
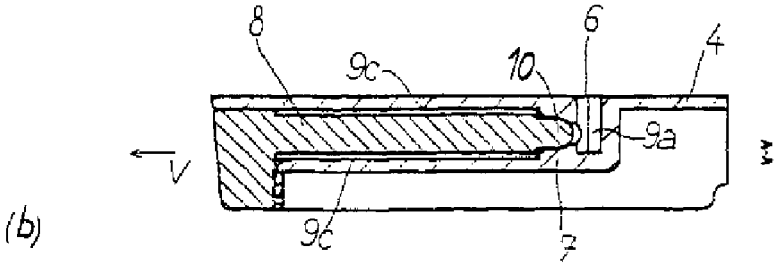

VENTILATED GRAVITY CUP FOR A PAINT SPRAY GUN

FIELD OF THE INVENTION

The invention pertains to a gravity cup for a paint spray gun.

BACKGROUND OF THE INVENTION

A gravity cup of this type is known from the state of the art, for example, from WO 98/32539. This gravity cup is realized in the form of a disposable cup and comprises a reservoir of plastic and a lid that can be placed thereon in order to close the reservoir. The upper side of the lid is provided with connecting means for attaching and fixing the gravity cup on a paint spray gun or an adapter arranged thereon. In this case, the gravity cup is attached to the paint spray gun "upside-down," i.e., with the lid side pointing downward. The paint in the gravity cup then flows downward into the paint inlet channel of the paint spray gun under the influence of gravity. This gravity feed of the paint can only be realized with a pressure compensation between the interior of the gravity cup and the surroundings. This pressure compensation is achieved with the aid of a ventilation hole that is arranged in the reservoir bottom and can be closed by means of an adhesive tape or a manually actuated valve.

Based on this state of the art, the invention aims to make available a gravity cup with a valve that can be easily actuated by hand in order to close the ventilation hole.

SUMMARY OF THE INVENTION

This objective is attained with a gravity cup with the characteristics of claim 1. Advantageous embodiments of this gravity cup are disclosed in the dependent claims.

BRIEF DESCRIPTION OF THE DRAWINGS

The invention is described in greater detail below with reference to an embodiment that is illustrated in the enclosed figures. The figures show:

FIG. 2, a top view of the left half of the reservoir bottom of the gravity cup shown in FIG. 1, in which a valve for closing a ventilation hole is arranged (FIG. 2*a*), as well as a section through this top view along the line A-A (FIG. 2*b*), wherein the valve is respectively illustrated in the open valve position;

FIG. 3, a representation identical to that shown in FIG. 2, but with the valve in the closed valve position, wherein FIG. 3*c* shows an additional section along the line B-B in FIG. 3*a*.

DETAILED DESCRIPTION OF THE INVENTION

Figure 1:
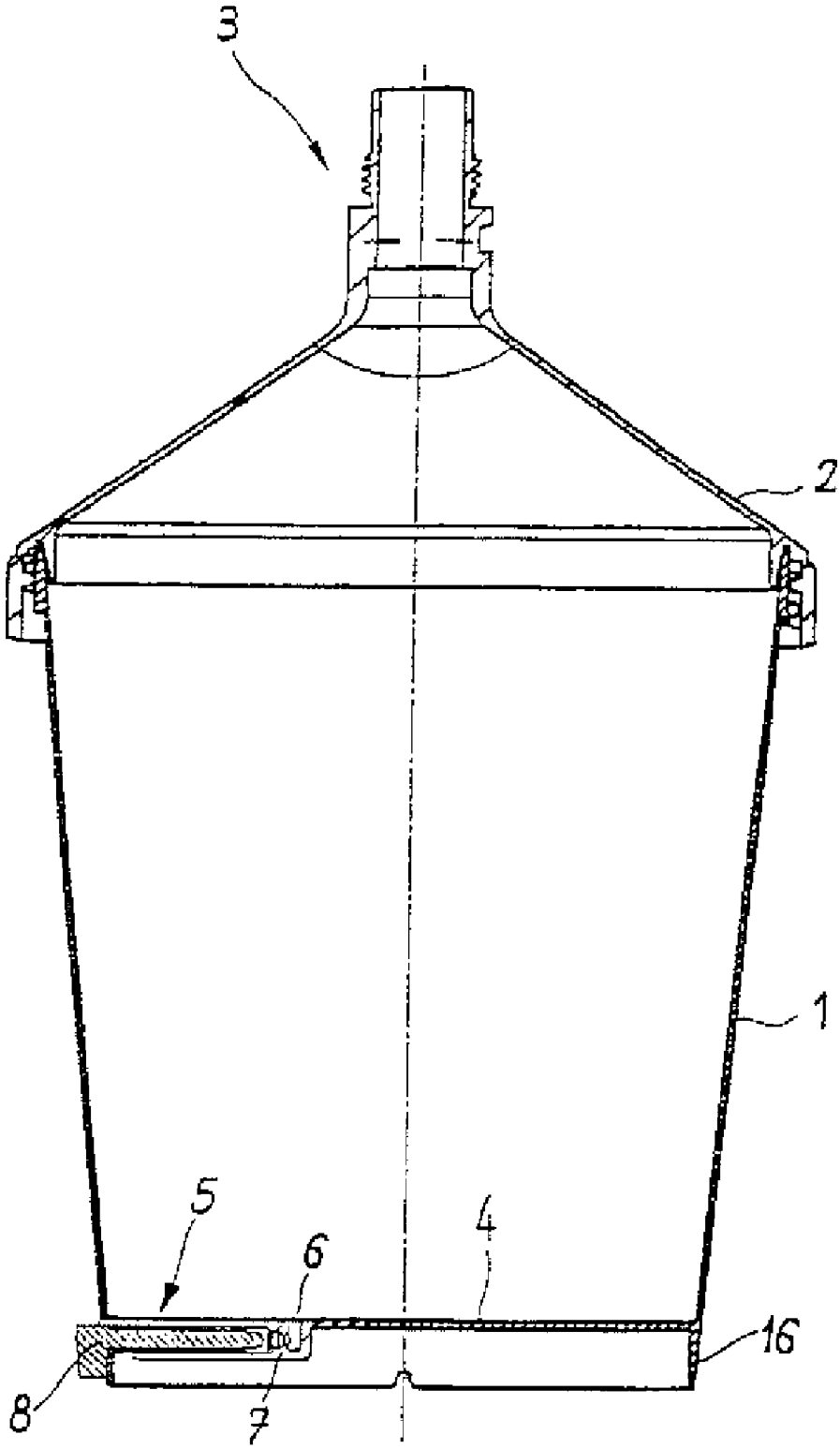
FIG. 1, a section through an inventive gravity cup.

The gravity cup shown in FIG. 1 comprises a cup-shaped reservoir 1 and a lid 2 that can be screwed thereon by means of threads. On its upper side, the lid 2 features an outlet connector with an outlet opening. The connecting part 3 is integrally molded onto the outer side of the outlet connector and serves for attaching and fixing the gravity cup on a paint spray gun or on an adapter arranged between the paint spray gun and the gravity cup. In the embodiment shown in FIG. 1, the connecting part 3 features threads and a wedge-shaped groove that cooperate with corresponding connecting parts on the paint spray gun, namely corresponding internal threads and a tongue for engaging in the groove. The reservoir 1 and the lid 2 are preferably realized in the form of injection-molded plastic parts.

The reservoir 1 is filled by removing the lid 2 and reattaching the lid after the reservoir is filled. Subsequently, the lid 2 with its connecting part 3 can be attached and fixed on the connecting part of a paint spray gun or an adapter. During the spraying process, the gravity cup is situated on the upper side of the paint spray gun and the liquid in the reservoir flows into the paint inlet channel of the paint spray gun under the influence of gravity.

This gravity feed of the liquid can only be maintained with a pressure compensation between the interior of the reservoir 1 and the surroundings. A ventilation hole 6 is provided in a wall 4 of the reservoir 1 for this purpose. In the embodiment shown in the figures, the ventilation hole 6 is arranged in the reservoir bottom. Alternatively, the ventilation hole 6 could also be arranged in the side wall of the reservoir 1, preferably in the vicinity of the bottom. A valve 5 is arranged on the underside of the reservoir bottom in order to close the ventilation hole 6. In addition, a cylindrical rim 16 is integrally molded onto the underside of the reservoir bottom and projects beyond the valve 5 such that the reservoir 1 can be placed on the ground while it is filled.

Figure 4:
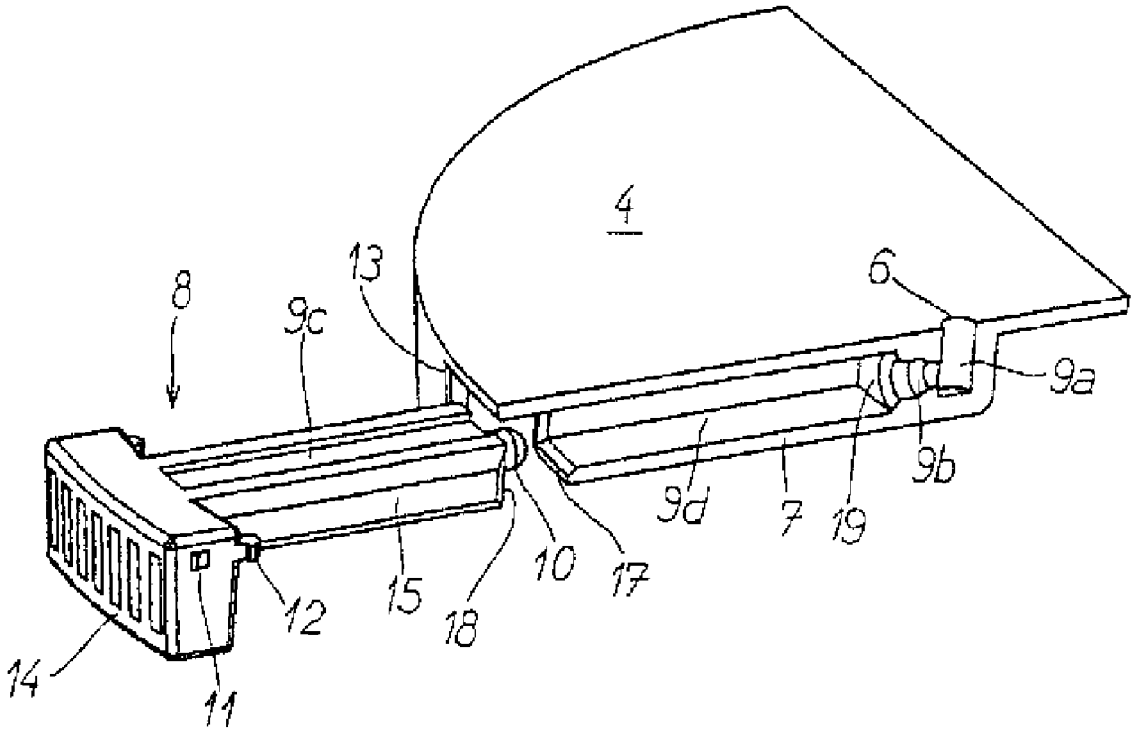
FIG. 4, a partially sectioned oblique representation of the valve components.

The valve 5 is illustrated in greater detail in FIGS. 2-4. It is realized in the form of a sliding valve and features a valve housing 7 arranged on the wall 4 and a slide 8. The slide 8 can be displaced relative to the valve housing 7. The valve housing 7 is integrally molded onto the wall 4 in the vicinity of the ventilation hole 6, as shown in FIG. 1. The slide 8 can be displaced within the valve housing 7 along a direction of displacement V that essentially extends parallel to the wall 4 of the reservoir 1 in which the ventilation hole 6 is arranged. In this context, the term "parallel" implies that the direction of displacement V extends exactly or at least approximately parallel to the plane of wall 4 or, if the wall 4 consists of a curved surface (for example, the cylindrical surface of a cup-shaped reservoir 1), that the direction of displacement V has at least approximately the same curvature as the curved wall 4.

FIG. 2*b*, for example, shows that a ventilation channel 9 in the valve housing 7 comprises a first bore 9*a* that leads into the ventilation hole 6 and a second bore 9*b* that leads into the first bore 9*a* at a right angle. The second bore 9*b* widens from a small bore diameter to approximately twice the bore diameter in two stages. The second bore 9*b* ultimately leads into a cuboid space 9*d* that is open toward the front, i.e., toward the outer side of the reservoir 1 (FIG. 4). The space 9*d* forms an insertion opening for inserting the slide 8 into the valve housing 7.

The slide 8 shown in FIG. 4 features a head part 14 as well as a cuboid piston 15 integrally molded thereto. A pin 10 is integrally molded onto the end of the piston 15 opposite to that of the head part 14. The upper side and the lower side of the piston 15 feature a groove-shaped recess 9*c* that extends along its entire length (FIG. 3*c* and FIG. 4). Lateral wedge-shaped stopping elements 11, 12 are integrally molded onto the head part 14 (FIG. 4).

When the gravity cup is used as intended, the piston 15 of the slide 8 is inserted into the space 9*d* of the valve housing 7. The slide 8 can then be displaced between a first valve position and a second valve position in the valve housing 7. In the first valve position (FIG. 3), the slide 8 is inserted into the valve housing 7 to such a degree that the pin 10 arranged on the front end of the slide 8 engages into and tightly seals the second bore 9*b* of the valve housing 7. The front side of the pin 10 is realized in a spherically rounded or conically tapered fashion in order to ensure the tightest seal possible. In the closed valve position, the spherically rounded region of the pin 10 adjoins the first conically widening region of the second bore 9*b*, as shown in FIG. 3*b*.

In the second valve position (FIG. 2), the slide 8 is retracted from the valve housing 7 to such a degree that the second bore 9*b* is unobstructed. This allows air to pass from the interior of the reservoir 1 through the ventilation hole 6 into the ventilation channel 9 with the first bore 9*a*, the second bore 9*b* and the space 9*d*. The recesses 9*c* are provided on the upper side and the lower side of the piston 15 in order to realize a pressure compensation between the interior of the reservoir 1 and the surroundings. These recesses 9*c* extend the ventilation channel 9 formed by the two bores 9*a*, 9*b* and the space 9*d* outward into the surroundings.

In the open valve position shown in FIG. 2, the stopping elements 12 of the slide 8 adjoin the inner side of the rim 16. This prevents the slide 8 from unintentionally sliding out of the valve housing 7 and being lost. The wedge-shaped stopping elements 11 are provided for fixing the slide 8 in the first, closed valve position shown in FIG. 3. The stopping elements clamp the head part 14 of the slide 8 against the inner side 13 of the rim 16 in the closed valve position, as shown in FIG. 3*a*. When the slide 8 needs to be displaced from the closed valve position into an open valve position, a certain force needs to be exerted in order to disengage the stopping elements 11 from the inner side 13 of the rim 16.

In the open valve position, the head part 14 of the slide 8 projects beyond the outer periphery of the reservoir 1, namely in the region of the rim, as shown in FIG. 1. This enables the user to ascertain that the valve 5 is in the open position in order to prevent the user from unintentionally adding liquid to reservoir 1 standing upright on the ground while the valve is open. In the closed valve position, the outer face of the head part 14 ends flush with the outer periphery of the reservoir 1 and the rim 16, respectively. In this valve position the inner face of the head part 14 adjoins the front edge 17 of the valve housing 7 that surrounds the insertion opening (FIG. 3*a*).

In addition to its simple and comfortable handling, the valve 5 is also characterized in that it is very tight. The tightness of the valve 5 can be additionally improved if it is realized in the form of a double valve with two valve seats. In addition to the first valve seat formed by the contact between the rounded region of the pin 10 and the conical region of the second bore 9*b*, a second valve seat can be realized by inserting a (not-shown) seal between the front face 18 of the piston 15 and the rear wall 19 of the space 9*d*. In this case, the additional valve seat is formed by the contact between the front face 18 of the piston 15 and the rear wall 19 of the space 9*d*.

The invention claimed is:

1. A gravity cup for a paint spray gun, comprising:

a reservoir having a top and a bottom and having a side wall and a bottom wall with a ventilation hole formed in one of said walls;

a lid placed on said reservoir and having a connecting part for attaching the gravity cup on a paint spray gun or an adapter;

a sliding valve member including a valve housing having an open end mounted on said one wall and defining a valve seat in the end thereof opposite the open end in communication with said ventilation hole via a ventilation channel, and a slide slidably received in said valve housing, said slide having a valve element;

wherein said slide is displaceable in said valve housing in a direction at least approximately parallel to said one wall between a first valve position in which the valve element of said slide is seated against the valve seat and thus closes the ventilation channel and a second valve position in which the valve element of said slide is unseated from the valve seat and thus opens the ventilation channel so that a pressure compensation between the interior of the reservoir and ambient is enabled.

2. The gravity cup according to claim 1 wherein the valve element is characterized by a spherically rounded or conically tapered shape.

3. The gravity cup according to claim 1, wherein the slide includes an elongated body having opposed ends with a head at one end of the elongated body and the valve element at the other end of the elongated body, said elongated body defining a passageway extending from said head to said other end of said elongated body to enable air flow.

4. The gravity cup according to claim 1 wherein the defined valve seat of the valve housing is characterized by a widening in two steps.

5. The gravity cup according to claim 1 wherein said ventilation channel includes a first bore leading from the ventilation hole and a second bore extending from said valve seat and joining said first bore at right angles thereto.

6. The gravity cup according to claim 3 wherein at least one stopping element is mounted on the head of the slide and the reservoir further includes a wall portion extending normal relative to said one wall, said wall portion having a defined opening aligned longitudinally with the slide, and wherein the defined opening in said wall portion, in the second valve position, coacts with the at least one stopping element to hold the slide under a press-fit and thereby securely maintain the valve element seated in the valve seat in the second valve position.

7. The gravity cup according to claim 6 wherein said one wall is the bottom wall of the reservoir and the wall portion is defined by a downward depending skirt.

8. The gravity cup according to claim 6 wherein said at least one stopping element is wedge-shaped.

9. The gravity cup according to claim 1, wherein the valve housing is integrally molded with said one wall on which it is mounted.

10. The gravity cup according to claim 1 wherein the reservoir further includes a wall portion extending normal relative to said one reservoir wall, said wall portion having a defined opening aligned longitudinally with the slide, and wherein at least one stopping element is mounted on said slide to prevent said slide from passing out through said defined opening, in the first valve position, by an interference contact between said at least one stopping element and said wall portion.

11. The gravity cup according to claim 1 wherein the slide and the valve housing mutually define, respectively, a second valve element coacting with a second valve seat.

12. The gravity cup according to claim 11 wherein the second valve element is defined by a first surface at said one end of the slide and the second valve seat is defined by a second surface surrounding said first-mentioned valve seat in the opposite end of the valve housing.

* * * * *